US005759277A

United States Patent [19]

Milovich et al.

[11] Patent Number: 5,759,277

[45] Date of Patent: *Jun. 2, 1998

[54] MANUAL AND AUTOMATIC APPARATUS FOR SUPPLYING CONDUCTIVE COATING MATERIALS INCLUDING TRANSFER UNITS HAVING A COMBINED SHUTTLE AND PUMPING DEVICE

[75] Inventors: Robert Milovich, Lorain; Ronald R. Schroeder, Amherst; William F. Parmentar, Vermilion; Julius J. Molnar, Amherst; Jack Penick, Westlake, all of Ohio

[73] Assignee: Nordson Corporation, Westlake, Ohio

[ * ] Notice: The term of this patent shall not extend beyond the expiration date of Pat. No. 5,549,755.

[21] Appl. No.: 650,891

[22] Filed: May 17, 1996

Related U.S. Application Data

[63] Continuation-in-part of Ser. No. 351,818, Dec. 8, 1994, Pat. No. 5,549,755.

[51] Int. Cl.[6] ..... B05B 5/00

[52] U.S. Cl. ..... 118/629; 118/300; 118/683; 118/684; 118/685; 239/690; 239/694; 239/708

[58] Field of Search ..... 118/683, 684, 118/685, 629, 300, 302, 313, 326; 239/690, 694, 708, 3

[56] References Cited

U.S. PATENT DOCUMENTS

| | | | |
|---|---|---|---|
| 277,305 | 5/1883 | Maltby . | |
| 482,776 | 9/1892 | Avery . | |
| 648,153 | 4/1900 | Serve . | |
| 1,549,332 | 8/1925 | Roberts . | |
| 2,660,456 | 11/1953 | Meddock | 121/38 |
| 2,811,950 | 11/1957 | Entz | 121/38 |
| 2,828,610 | 4/1958 | Bruehl | 60/51 |
| 2,898,130 | 8/1959 | Hansen | 285/96 |
| 3,063,423 | 11/1962 | Riordan | 121/38 |
| 3,104,619 | 9/1963 | Swarthout | 103/204 |
| 3,122,320 | 2/1964 | Beck et al. | 239/3 |
| 3,240,225 | 3/1966 | Barrows | 137/240 |
| 3,315,899 | 4/1967 | Quarve | 239/586 |
| 3,747,850 | 7/1973 | Hastings et al. | 239/3 |
| 3,818,807 | 6/1974 | Semple | 92/865 |
| 3,895,748 | 7/1975 | Klingenberg | 222/571 |
| 3,906,122 | 9/1975 | Krause et al. | 427/33 |
| 3,929,286 | 12/1975 | Hastings et al. | 239/3 |
| 3,937,400 | 2/1976 | Krause | 239/11 |
| 3,971,337 | 7/1976 | Hastings | 118/629 |
| 3,999,691 | 12/1976 | Doom | 222/330 |

(List continued on next page.)

FOREIGN PATENT DOCUMENTS

| | | |
|---|---|---|
| 0394084 | 3/1990 | European Pat. Off. . |
| 0455109 | 4/1991 | European Pat. Off. . |
| 2853347 | 12/1978 | Germany . |
| 3725172 | 7/1987 | Germany . |
| 5154638 | 11/1974 | Japan . |
| 7800307 | 1/1978 | Netherlands . |
| WO87/05832 | 10/1987 | WIPO . |
| WO88/04957 | 7/1988 | WIPO . |

OTHER PUBLICATIONS

Publication from GMFanuc Robotics Corp. for "ACCUSTAT 1000" (undated).

*Primary Examiner*—Laura Edwards
*Attorney, Agent, or Firm*—Holland & Knight LLP

[57] ABSTRACT

An apparatus for supplying electrically conductive coating material, such as water-based paint, includes a manifold connected to a high voltage electrostatic power supply and to one or more coating dispensers, and, a number of coating transfer units which are movable between a discharge position or station at the manifold and a filling station physically spaced from the manifold. Each of the transfer units includes a combined shuttle and pumping device which initially receives coating material at the filling station, and is then movable to the discharge station where the coating material is transferred from the pumping device, through the manifold, and then to one or more coating dispensers for deposition onto a substrate.

5 Claims, 10 Drawing Sheets

U.S. PATENT DOCUMENTS

| | | | |
|---|---|---|---|
| 4,004,717 | 1/1977 | Wanke | 222/255 |
| 4,017,029 | 4/1977 | Walberg | 239/15 |
| 4,020,866 | 5/1977 | Wiggins | 137/592 |
| 4,053,012 | 10/1977 | Farmer | 164/254 |
| 4,085,892 | 4/1978 | Dalton | 239/15 |
| 4,124,163 | 11/1978 | Siegmann | 239/533.15 |
| 4,138,931 | 2/1979 | Hermann et al. | 92/87 |
| 4,142,707 | 3/1979 | Bjorklund | 251/77 |
| 4,275,834 | 6/1981 | Spanjersberg et al. | 239/3 |
| 4,313,475 | 2/1982 | Wiggins | 141/18 |
| 4,489,893 | 12/1984 | Smead | 239/691 |
| 4,544,570 | 10/1985 | Plunkett et al. | 427/27 |
| 4,576,359 | 3/1986 | Oetiker | 251/149.6 |
| 4,629,119 | 12/1986 | Plunkett et al. | 239/63 |
| 4,657,047 | 4/1987 | Kolibas | 137/881 |
| 4,660,598 | 4/1987 | Butterfield | 137/510 |
| 4,771,729 | 9/1988 | Planert et al. | 118/697 |
| 4,785,760 | 11/1988 | Tholome | 118/323 |
| 4,792,092 | 12/1988 | Elberson et al. | 239/3 |
| 4,878,622 | 11/1989 | Jamison et al. | 239/690.1 |
| 4,879,137 | 11/1989 | Baker et al. | 427/27 |
| 4,921,169 | 5/1990 | Tilly | 239/3 |
| 4,932,589 | 6/1990 | Diana | 239/3 |
| 4,962,724 | 10/1990 | Prus et al. | 118/688 |
| 4,971,337 | 11/1990 | Hufford | 77/85 |
| 5,014,645 | 5/1991 | Cann et al. | 118/663 |
| 5,078,168 | 1/1992 | Konieczynski | 137/566 |
| 5,083,711 | 1/1992 | Giroux et al. | 239/690 |
| 5,094,389 | 3/1992 | Giroux et al. | 239/690 |
| 5,152,466 | 10/1992 | Matushita et al. | 239/690 |
| 5,197,676 | 3/1993 | Konieczynski et al. | 239/690 |
| 5,221,194 | 6/1993 | Konieczynski et al. | 417/430 |
| 5,271,569 | 12/1993 | Konieczynski | 239/3 |
| 5,310,120 | 5/1994 | Ehinger et al. | 239/708 |
| 5,326,031 | 7/1994 | Konieczynski | 239/708 |
| 5,518,186 | 5/1996 | Weinstein | 118/629 |
| 5,526,986 | 6/1996 | Padgett et al. | 118/629 |

FROM COATING MATERIAL SUPPLY
70
68a
FROM CONTROLLER
68b
68c
68d
68e
WATER SUPPLY
56
58
34a
34b
34c
34d
34e
10

42a
42b
42c
42d
42e
22
ELECTROSTATIC POWER SUPPLY
48
52
12a
12b
12c
12d
12e
126
128
32
16
20
30
74
26
24
18
28
76
130
78
50
12f
12g
12h
12i
12j
54
66
34f
34g
34h
34i
34j
AIR SUPPLY
64
60
42f
42g
42h
42i
42j
68f
68g
68h
68i
68j
72
CONTROLLER
62
COATING MATERIAL SUPPLY
36

MANUAL AND AUTOMATIC APPARATUS FOR SUPPLYING CONDUCTIVE COATING MATERIALS INCLUDING TRANSFER UNITS HAVING A COMBINED SHUTTLE AND PUMPING DEVICE

RELATED APPLICATIONS

This application is a Continuation-In-Part of U.S. patent application Ser. No. 08/351,818 to Milovich et al., filed Dec. 8, 1994, now U.S. Pat. No. 5,549,755 and entitled "Apparatus for Supplying Conductive Coating Materials Including Transfer Units Having a Combined Shuttle and Pumping Device."

FIELD OF THE INVENTION

This invention relates to electrostatic spray coating, and, more particularly, to a method and apparatus for dispensing a number of different colored coating materials from separate sources trough individual coating transfer units each including a combined shuttle and pumping unit connectable to a common manifold which communicates with one or more manually or automatically operated coating dispensers.

BACKGROUND OF THE INVENTION

The application of coating materials using electrostatic spraying techniques has been practiced in industry for many years. In these applications, the coating material is discharged in atomized form and an electrostatic charge is imparted to the atomized particles which are then directed toward a substrate maintained at a different potential to establish an electrostatic attraction for the charged atomized particles. As described in detail in U.S. Pat. Nos. 5,078,168 and 5,221,194, both owned by the assignee of this invention, the recent trend has been to shift away from the use of solvent based coating materials, e.g. varnishes, lacquers, enamels and the like, in favor of water-based coatings which reduce problems of explosiveness and toxicity associated with solvent-based coatings. Unfortunately, this switch from electrostatically spraying solvent-based coating to those of the water-based type has sharply increased the risk of electrical shock among system operators.

The problem of electrical shock from water-based coatings is addressed in U.S. Pat. Nos. 5,078,168 and 5,221,194 wherein a "voltage block" system is provided for transferring electrically conductive coating materials without the formation of a completed electrical path between the source of coating material and a high voltage electrostatic power supply. The system in U.S. Pat. No. 5,078,168, for example, comprises first and second shuttle devices which are serially connected to two large reservoir piston pumps. The first shuttle is movable between a transfer position and a neutral position with respect to a filling station which is connected to a source of electrically conductive coating material. At the filling station, the first shuttle is operative to transfer coating material from the source into the reservoir of the first pump. In the neutral position, the first shuttle is electrically isolated, i.e. physically spaced, from the filling station. The second shuttle device is movable between a transfer position wherein it interconnects the first piston pump with the second piston pump, and a neutral position wherein the two pumps are electrically isolated from one another and the second piston pump supplies coating material to one or more dispensers. Movement of the shuttles is controlled to maintain one of the shuttles in a neutral position at all times during a coating operation so that there is never a completed electrical path between the source(s) of electrically conductive coating material and the electrostatically charged coating material at the dispenser(s).

Systems of the type disclosed in U.S. Pat. Nos. 5,078,168 and 5,221,194, in which the shuttles and pumps are connected in series with one another between the source of coating material and one or more coating dispensers, have suffered to some extent from problems of inadequate pressure at the coating dispensers and pressure fluctuations within the system. These problems have been addressed in U.S. Pat. No. 5,326,031, entitled "Apparatus for Dispensing Conductive Coating Materials Including Color Changing Capability," which is owned by the assignee of this invention. In this system, electrically conductive coating material is transmitted from two "parallel" flow paths to one or more coating dispensers. Each flow path comprises a voltage block construction including a transfer unit having a filling station connected to the source(s) of coating material, a discharge station spaced from the filling station and a shuttle movable between and releasably coupled to the filling station and to the discharge station. Upon movement of the shuttle to the filling station of the transfer unit within one of the two flow paths, the shuttle is effective to transfer coating material from the source into the reservoir of a piston pump associated with such flow path. When the reservoir of the piston pump is filled, the shuttle moves and is coupled to the discharge station wherein a connection is made allowing the coating material to be transferred from the pump reservoir, through the discharge station of the transfer unit, and, into a valve connected to the dispensers. This valve is common to both flow paths and is effective to switch the flow of coating material to the dispensers from one flow path to the other. The operation of the system is synchronized such that when the pump of one flow path is supplying coating material to the dispensers, the pump of the other flow path is receiving coating material from the source. A voltage block is continuously maintained between the source and charged dispensers, and the dispensers can be essentially continuously supplied with coating material from one or the other of the parallel flow paths.

Both the series system and parallel system described above employ large reservoir piston pumps and connective lines or tubing to transfer the coating material to separate shuttle devices, which, in turn, communicate with the coating dispensers. While these arrangements provide an effective voltage block or discontinuous path between the source (s) of coating material and a coating dispenser(s), there are certain applications in which space considerations and color change requirements make the use of such systems impractical. For example, in automotive or other vehicle paint lines, the coating supply system must be capable of rapidly changing from one color of coating material to another, and there is a limited amount of floor space which the coating system can occupy within the production facility. The provision of separate reservoir pumps and shuttles in both of the systems described above, and the tubing required to interconnect such elements with the source(s) of coating material and coating dispensers, requires more space than is available at many automotive facilities. Additionally, switch-over from a coating material of one color to another is delayed by the presence of separate pumps and shuttles, as well as the tubing therebetween, and the control functions required to achieve such changeover can be complicated.

SUMMARY OF THE INVENTION

It is therefore among the objectives of this invention to provide a method and apparatus of supplying conductive coating material, such as water-based paint, which protects against the transmission of an electrostatic charge between a high voltage electrostatic power supply and one or more conductive coating supplies, which is compact in construction, which reduces the system elements required to transfer coating material from one or more sources to coating dispensers, which is comparatively easy to clean, and, which permits the rapid change of supply of a coating material of one color to a coating material of a different color.

These objectives are accomplished in an apparatus for supplying electrically conductive coating material, such as water-based paint, which includes a manifold connected to a high voltage electrostatic power supply and to one or more coating dispensers, and, a number of coating transfer units which are movable between a coupled, discharge position or station at the manifold and a filling station physically spaced from the manifold. Each of the transfer units includes a combined shuttle and pumping device which initially receives coating material at the filling station, and is then movable to the discharge station at the manifold where the coating material is transferred from the pumping device, through the manifold, and then to one or more coating dispensers for deposition onto a substrate.

This invention is therefore predicated upon the concept of eliminating separate reservoir pumps and shuttles found in the series and parallel coating supply systems of the type described above. Instead, the shuttles and pumping devices are combined in a single, movable coating transfer unit. At the filling station, where the coating transfer units receive different colors of coating material from separate sources, each coating transfer unit is physically spaced from the charged manifold therefore providing an effective voltage block between the electrostatic power supply and the source of coating material connected thereto. Depending upon the color of coating material desired, the shuttle and pumping device of one coating transfer unit is moved to a discharge position at the manifold where the pumping device is activated to transfer coating material of that desired color into the manifold for supply to the coating dispensers. This provides a compact and efficient means of selectively supplying coating material from a number of sources, to one or more coating dispensers, while maintaining a continuous voltage block between the electrostatic power supply and coating material sources.

In one presently preferred embodiment of this invention, each coating transfer unit comprises a shuttle connected to the piston rod of a fluid cylinder which is extendable to move the shuttle along a pair of guide rods to the discharge station at the manifold, and retractable to return the shuttle to a filling station spaced from the manifold. A pumping device is affixed to the shuttle and movable therewith. The pumping device includes a pump body having a hollow interior connected by passageways formed in the shuttle to a pair of coupling elements carried by the shuttle which are engageable with a second pair of coupling elements located at the filling station. A piston head is mounted within the hollow interior of the pumping device which is connected to one end of a pump rod whose other end mounts a coupling element externally of the pump interior. Coating material is introduced into the interior of the pumping device at the filling station through one pair of the mating coupling elements carried by the shuttle and filling station, and the other pair of coupling elements are provided to permit recirculation of the coating material from the pumping device back to the source while the shuttle and pumping device are located at the filling station.

In order to discharge coating material from a coating transfer unit, the piston rod of the associated fluid cylinder is extended to move the shuttle and pumping device from the filling station to the discharge station at the manifold. In this position, a fixed coupling element connected to the manifold mates with the coupling element at the outwardly extending end of the pump rod. Once the coupling elements of the pump rod and manifold are coupled, the force exerted by the piston rod of the fluid cylinder in a direction toward the manifold causes the pump rod and piston head within the interior of the pumping device to move in the opposite direction because the coupling element at the manifold is fixed. As a result, the coating material within the pump interior is forced into a central passageway formed in the pump rod, through the interconnected coupling elements of the pump rod and manifold, and then into the manifold itself. The manifold, in turn, supplies the coating material through separate lines to one or more coating dispensers. After the pumping device is emptied of coating material, or it is otherwise desired to terminate the coating operation, the fluid cylinder retracts its piston rod to return the shuttle and pumping device from the discharge station at the manifold to the filling station.

In other embodiments of this invention, the manifold is eliminated, and each discharge station comprises a coupling element mounted to a support bar. An automatic version of the apparatus herein is provided wherein each coupling element is connected to a color changer which, in turn, is connected to one or more coating dispensers. In a manually operated embodiment, the discharge stations are each directly connected by a line to a hand-held coating dispenser which is actuated by an operator, as desired.

In an alternative embodiment of this invention, a variation of the above-described coating transfer units is provided. Each coating transfer unit of this embodiment comprises a shuttle having a hollow interior which receives a pumping device movable therein along a shaft extending through the shuttle. The shaft is formed with an inlet passageway extending from one end thereof to an outlet midway along the shaft, and a discharge passageway is also formed in the shaft having an inlet midway along the shaft and an outlet at the opposite end thereof. A coupling element is mounted to each end of the shaft. The pumping device, in turn, has a hollow interior within which a pump piston is freely movable along the shaft.

In response to the introduction of pressurized air into the interior of the shuttle on one end of the pumping device carried therein, the shuttle and pumping device are movable as a unit along guide rods to the filling station where the coupling element at one end of the shaft mates with a coupling element at the filling station. Coating material is supplied through such mating coupling elements into the inlet passageway of the shaft, and exits through the outlet thereof into the hollow interior of the pumping device. The pumping device receives coating material until its pump piston is moved to one end of the pump body.

The shuttle and pumping device are then moved to the discharge station at the manifold by pressurizing the interior of the shuttle at the opposite end of the pumping unit. This forces the shuttle and pumping device away from the filling station and into position at the discharge station where the coupling element at the opposite end of the shaft mates with a coupling element located at the discharge station and connected to the manifold. The pumping device is provided with an air inlet port in a position such that pressurization of the shuttle causing it to move to the discharge station also pressurizes the interior of the pumping device. As a result, once the coupling elements of the shaft and manifold mate with one another at the discharge station, pressurization of the interior of the pumping device forces its pump piston in a direction toward the manifold thus discharging coating material from the interior of the pumping device through the discharge passageway in the shaft. The coating material exits the shaft through the mating coupling elements at the discharge station, and is then transferred through the manifold to one or more coating dispensers. The shuttle and pumping device are returned to the filling station by again pressurizing the interior of the shuttle on the opposite end of the pumping device, i.e. opposite the air port within the pumping device, while venting the other side of the shuttle.

In the presently preferred embodiment, one or more water shuttles, each connected to a source of water, are movable into coupling engagement with the manifold after a coating operation with one color of coating material has been completed. The water shuttle functions to introduce water or other flushing liquid into the manifold, and the lines connecting the manifold to the coating dispensers, to remove coating material of one color after the completion of a coating operation in preparation for receipt of a coating material of a different color. An air valve is also connected to the manifold, and to a source of pressurized air, so that air can be introduced with the water and/or separately to assist in the cleaning operation.

The system is also provided with a water transfer unit, releasably coupled to the manifold, which is used to direct water through a separate tube within the interior of the manifold directly to the coating dispensers. This water transfer unit can be used in instances where a color change is not desired but there is some interval of time between operation of the dispensers, during which period the coating material could clog the coating dispenser and produce an unacceptable finish. This water transfer unit removes such coating material resident within the dispensers prior to resumption of a coating operation.

An important advantage of the apparatus of this invention, in both of die embodiments mentioned above, is the elimination of separate pumping devices, separate shuttles, and the tubing connected therebetween. The provision of combined shuttle and pumping devices, which are movable as a unit between the filling and discharge stations, reduces the space requirements for the overall apparatus and simplifies the cleaning operation. Further, the use of a manifold eliminates the need for color changers and provides a convenient means for applying an electrostatic charge to the coating material, e.g. by interconnecting the electrically conductive manifold with a high voltage electrostatic power supply. Additionally, the water shuttle, water transfer unit and air valve associated with the manifold provide rapid and simplified cleaning of the manifold, the lines connected to coating dispensers, and, the coating dispensers themselves.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
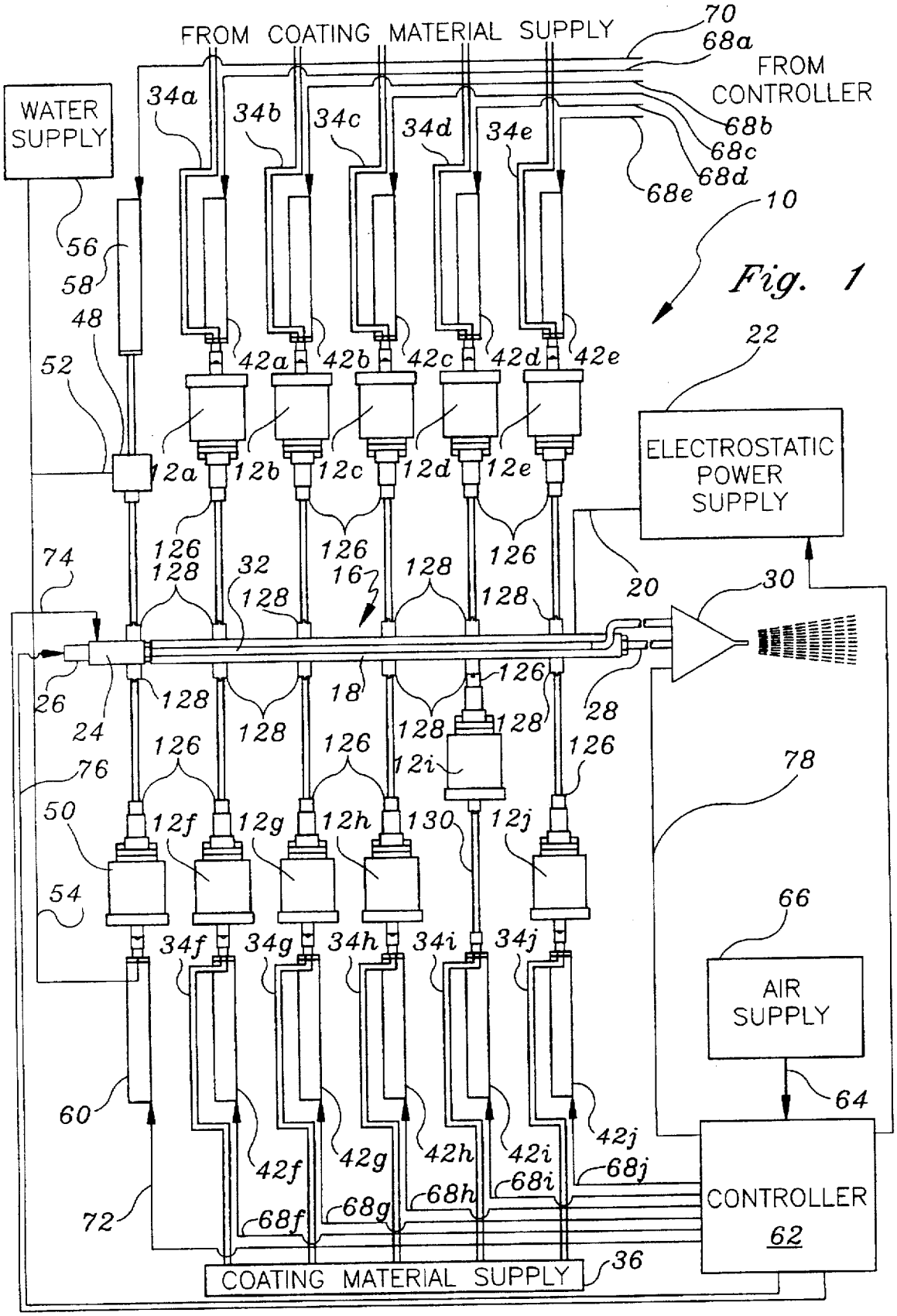
FIG. 1 is a schematic view of the overall apparatus of this invention wherein coating material of one color is being supplied to a dispenser.
Figure 2:
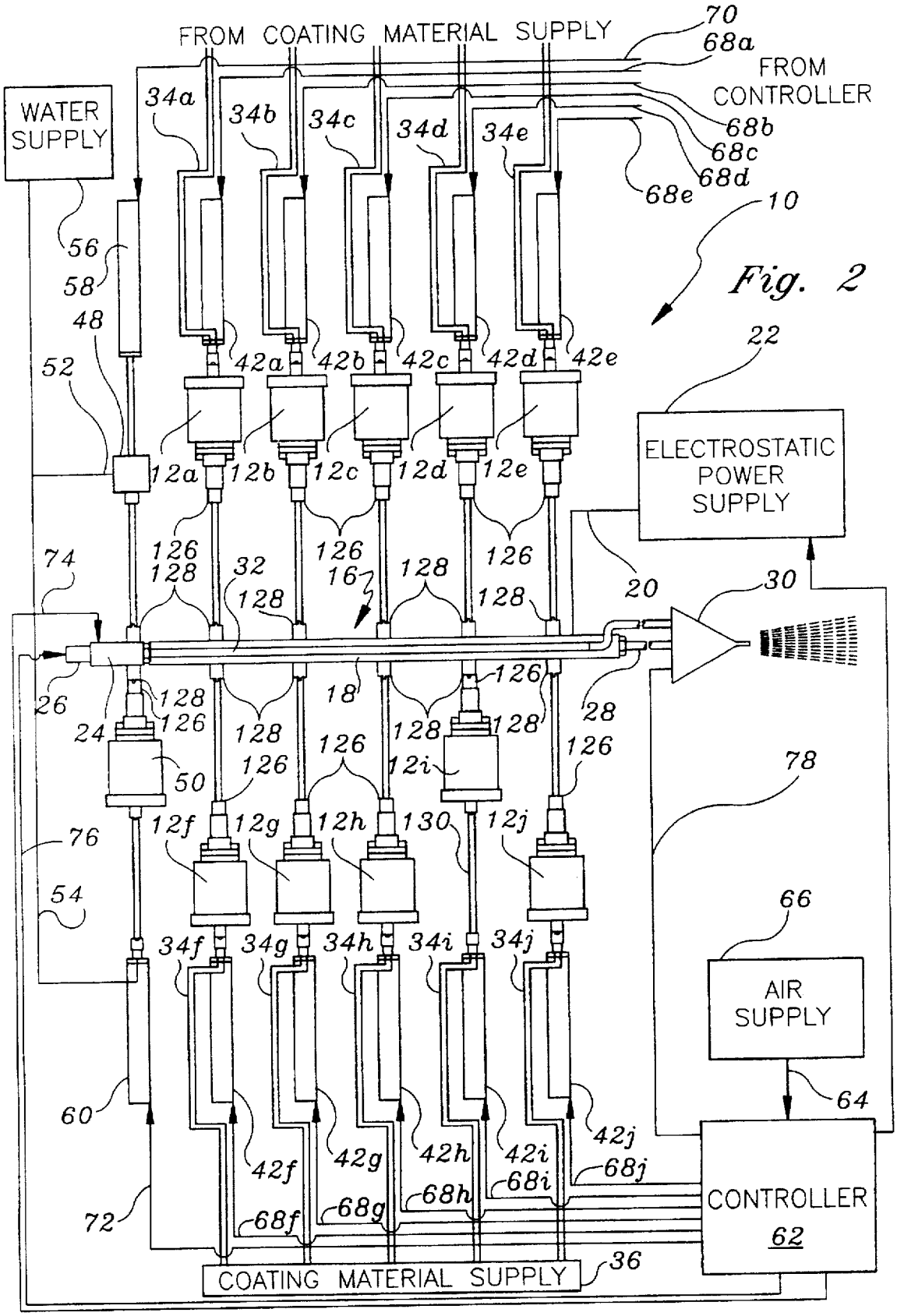
FIG. 2 is a view similar to FIG. 1 illustrating one aspect of the cleaning operation of the apparatus.
Figure 3:
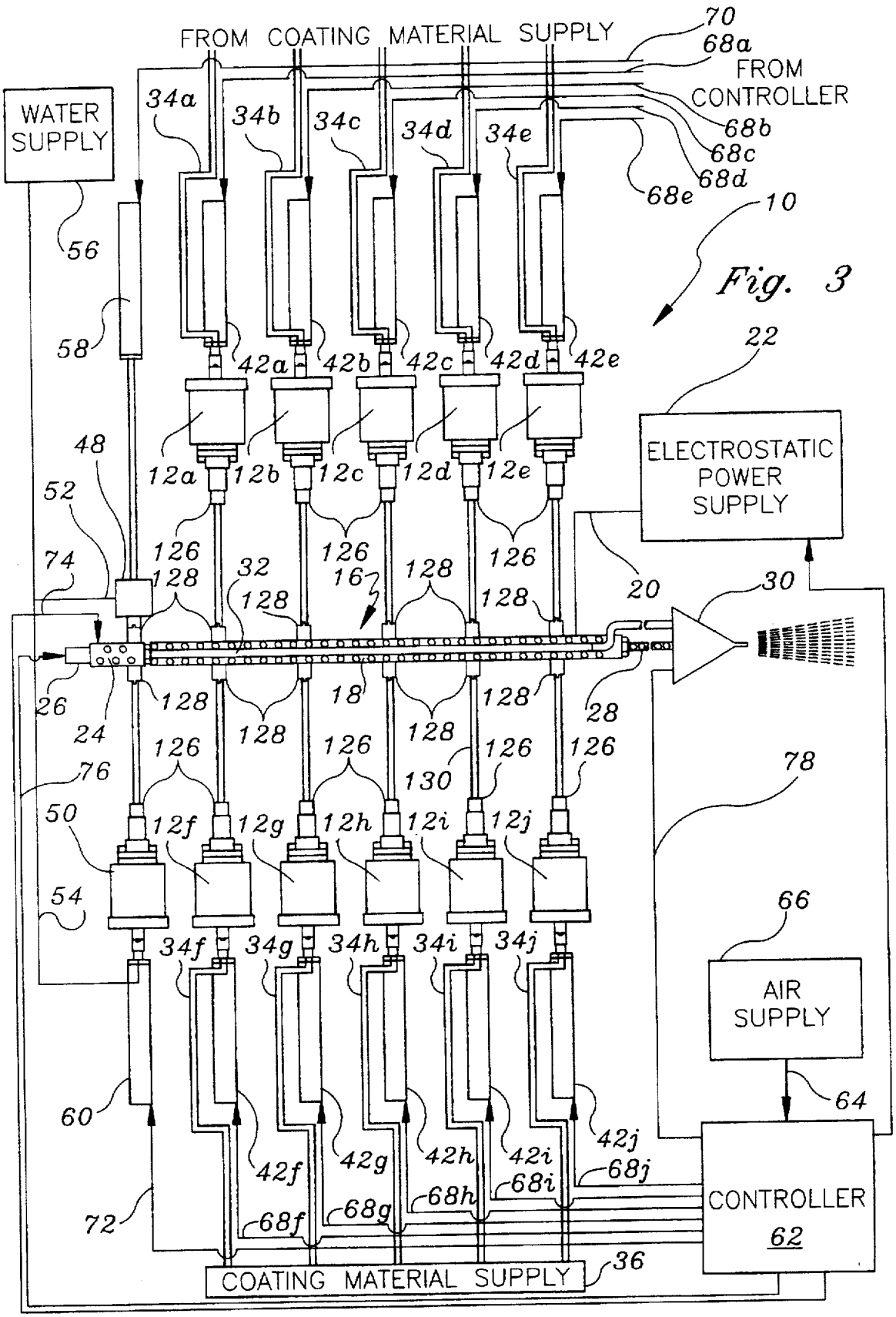
FIG. 3 is a view similar to FIG. 1 illustrating a water/air flush sequence of operation.

With reference to FIG. 1, one embodiment of the apparatus 10 of this invention is shown with a number of coating transfer units 12 schematically depicted. For purposes of the present discussion, the overall construction of apparatus 10 will be described initially, followed by a detailed description of one preferred embodiment of the transfer units 12 shown in FIGS. 5 and 6. An alternative embodiment of transfer units 14 is then described with reference to FIGS. 7 and 8. Additionally, alternative embodiments of apparatus 300 and 301 are described with reference to FIGS. 9*a* and 9*b*. Finally, the operation of apparatus 10, 300 and 301 is described, using either the transfer units 12*a–j*, with particular reference to FIGS. 1–4 and 9*a*.

Overall Construction of Apparatus 10

The apparatus 10 includes a manifold 16 which is tubular in shape and has a hollow interior 18 closed at opposite ends. Preferably, the manifold is formed of metal or other electrically conductive material which is connected by a high voltage line 20 to an electrostatic power supply 22. One end of the manifold 16 mounts a water valve 24 and an air purge valve 26. The opposite end of manifold 16 is connected by a paint supply tube 28 to one or more of coating dispensers 30. Preferably, the dispensers 30 are spray guns of the type sold by Nordson Corporation of Westlake, Ohio, the assignee of this invention, under Model No. AN-9, or rotary atomizers sold by Nordson Corporation under Model No. RA-12. Additionally, a water flush tube 32 is carried within the interior 18 of manifold 16, which is connected at one end to the water valve 24 and at the opposite end to the dispenser 30.

In the embodiment of apparatus 10 depicted in FIGS. 1–4, a total of ten transfer units 12*a–j* are shown. It should be understood that essentially any number of transfer units 12*a–j* could be employed with the apparatus 10 of this invention depending upon the requirements of a particular application. Each of the transfer units 12*a–j* are connected by a separate line 34*a–j*, respectively, to a coating material supply 36 shown schematically in FIG. 1. As better shown in FIGS. 5 and 6, and described in more detail below, the coating material supply 36 comprises a number of tanks or containers 38, each of which is filled with a coating material of different color and connected to a pump 40. These pumps 40 are connected, in turn, to a respective one of the lines 34*a–j* leading to transfer units 12*a–j*. Consequently, each transfer unit 12*a–j* has a dedicated or separate container 38 and pump 40 associated therewith so that a different colored coating material can be supplied to manifold 16 from each transfer unit 12*a–j*, as described in detail below. In the embodiment of apparatus 10 shown in FIGS. 1–6, each of the transfer units 12*a–j*, in turn, is connected to a fluid cylinder 42*a–j*, respectively, which are preferably pneumatic or hydraulic in operation. As described in more detail below in connection with a discussion of FIGS. 5 and 6, the fluid cylinders 42*a–j* are effective to move the transfer units 12*a–j* between a filling position or station 44 spaced from the manifold 16, and a discharge position or station 46 located at the manifold 16.

In addition to the coating material transfer units 12*a–j*, the apparatus 10 of this invention includes a water shuttle 48 and a water transfer unit 50 which are connected by lines 52, 54, respectively, to a water supply 56. The water shuttle 48 is movable between a neutral position spaced from the manifold 16, and a transfer position located at the manifold 16, by operation of a fluid cylinder 58. Similarly, the water transfer unit 50 is movable between a neutral position and a transfer position with respect to the manifold 16 by operation of a second fluid cylinder 60 connected thereto. As described in more detail below, both the water shuttle 48 and water transfer unit 50 are releasably coupled to the water valve 24 to supply flushing liquid into and through the interior 18 of manifold 16, or through the water flush tube 32, to the coating dispenser(s) 30.

The entire operation of apparatus 10 is governed by a commercially available controller 62 of the type having internal pneumatic valves and programmable controls. The controller 62 is connected by a line 64 to a pressurized air supply 66, and by a series of other lines to each of the elements of apparatus 10. Specifically, the controller 62 is connected by lines 68*a–j* to respective fluid cylinders 42*a–j*, and by lines 70 and 72 to the fluid cylinders 58, 60, respectively. The operation of water valve 24 and air purge valve 26 is governed by the controller 62 via signals through lines 74 and 76, respectively, and the operation of coating dispenser 30 is controlled by the controller 62 via line 78. The detailed operation of controller 62 is discussed below in connection with a description of the operation of apparatus 10.

Overall Construction of Apparatus 300 and 301

Figure 9A:
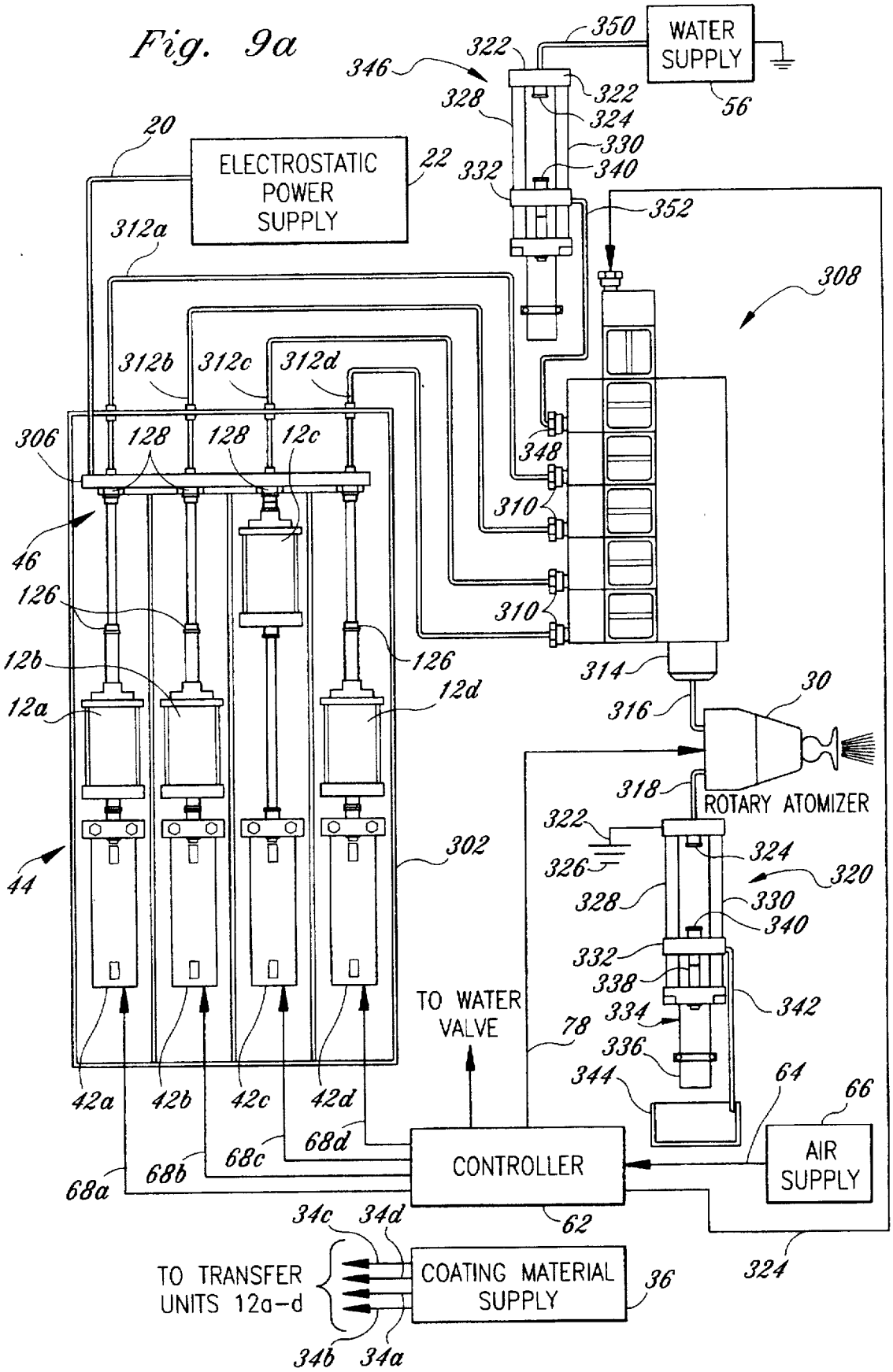
FIG. 9*a* is a view of an alternative embodiment of the coating transfer system of this invention employing a color changer and automatically actuated coating dispensers.

With reference now to FIG. 9*a*, an alternative embodiment of an apparatus 300 according to this invention is schematically depicted. The apparatus 300 is similar in many respects to apparatus 10 described above and shown in FIGS. 1–4. For purposes of the present discussion, structure shown in apparatus 300 which is common to that of apparatus 10 is given the same reference numbers in FIG. 9*a* as in FIGS. 1–4.

In the embodiment shown in FIG. 9*a*, the apparatus 300 includes four coating material transfer units 12*a–d* of the same type described above, which are mounted within a cabinet 302 by mounting rods 304. Each transfer unit 12*a–d* is connected by a line 34*a–d*, respectively, to the same type of coating material supply 36 shown in FIG. 1. As described above, movement of the transfer units 12*a–d* is controlled by operation of fluid cylinders 42*a–d*, respectively, which are controlled by controller 62 via lines 68*a–d*.

The transfer units 12*a–d* are movable between a filling station 44 located at their respective fluid cylinders 42*a–d*, and a discharge position or station 46 located at a support bar 306 carried at the top of cabinet 302. This support bar 306 is connected by high voltage line 20 to electrostatic power supply 22 as in FIG. 1.

The primary difference between apparatus 300 and apparatus 10 is the mainner in which different colored coating materials are transmitted from the various transfer units 12*a–d* to one or more coating dispensers 30. Instead of a manifold 16, the apparatus 300 of this embodiment employs a color changer 308 which is interposed between the transfer units 12*a–d* and at least one coating dispenser 30 such as described above. In the presently preferred embodiment, the color changer 308 is of the type described in U.S. Pat. No. 4,657,047 to Kolibas, owned by the assignee of this invention, the disclosure of which is incorporated by reference in its entirety herein. Color changer 308 includes a number of inlets 310 each connected by a line 312*a–d*, respectively, to one of the transfer units 12*a–d*. As disclosed in U.S. Pat. No. 4,657,047, the color changer 308 has an outlet 314 connected by a supply line 316 to dispenser 30. Preferably, the dispenser 30 is connected by a discharge line 318 to a voltage block 320 of the type described in U.S. Pat. No. 5,341,990 to Konieczynski, the disclosure of which is incorporated herein by reference in its entirety.

For purposes of the present discussion, the voltage block 320 comprises a filling station 322 having a male coupling element 324 connected to discharge line 318. The filling station 322 is grounded at 326. The filling station 322 mounts a pair of spaced rods 328 and 330 along which a shuttle 332 is axially slidable by operation of a pneumatic cylinder 334. The pneumatic cylinder 334 has a cylinder housing 336 mounted to one of each of the rods 328, 330, and a cylinder rod 338 connected to the shuttle 332. In response to operation of pneumatic cylinder 334, the shuttle 332 is moved along rods 328, 330 between a coupling or transfer position wherein a female coupling element 340 carried by the shuttle 332 engages the male coupling element 324, and a neutral, physically-spaced position wherein the shuttle 332 is spaced from the filling station 322. Preferably, the male and female coupling elements 324 and 340 are of the type disclosed in U.S. Pat. No. 5,078,168 to Konieczynski, the disclosure of which is hereby incorporated herein by reference in its entirety. As depicted in FIG. 9*a*, a dump line 342 is connected between the female coupling element 340 and a dump tank 344 so that when the male and female coupling elements 324, 340 are interconnected, a flow path is provided from the dispenser 30 into the tank 344 to discharge overflow or waste fluids from the dispenser 30.

Additionally, a second voltage block 346 is interposed between the water supply 56 and the water inlet 348 of color changer 308. The second voltage block 346 is identical in construction and operation to the voltage block 320 described above, and the same reference numbers are used to identify common elements of same. As depicted in FIG. 9*a*, a water line 350 is connected between the water supply 56 and the male coupling element 324 of voltage block 320, and the female coupling element 340 is connected by a line 352 to the water inlet 348 of color changer 308.

As described in more detail below, the transfer units 12*a–d* are selectively movable to a discharge position 46 at the support bar 306 where they are interconnected to a respective coating line 312*a–d* for the transmission of coating material to the color changer 308. The color changer 308, in turn, supplies the coating material to dispenser 30 for application onto a substrate.

The apparatus 300 described above in connection with the discussion of FIG. 9*a* employs a rotary atomizer or dispenser 30 whose operation is controlled by the controller 62 via line 78, as discussed more fully below. As such, the apparatus 300 is "automatic" in operation, i.e., no manual intervention is employed to turn on and off the flow of coating material from the dispenser 30.

Figure 9B:
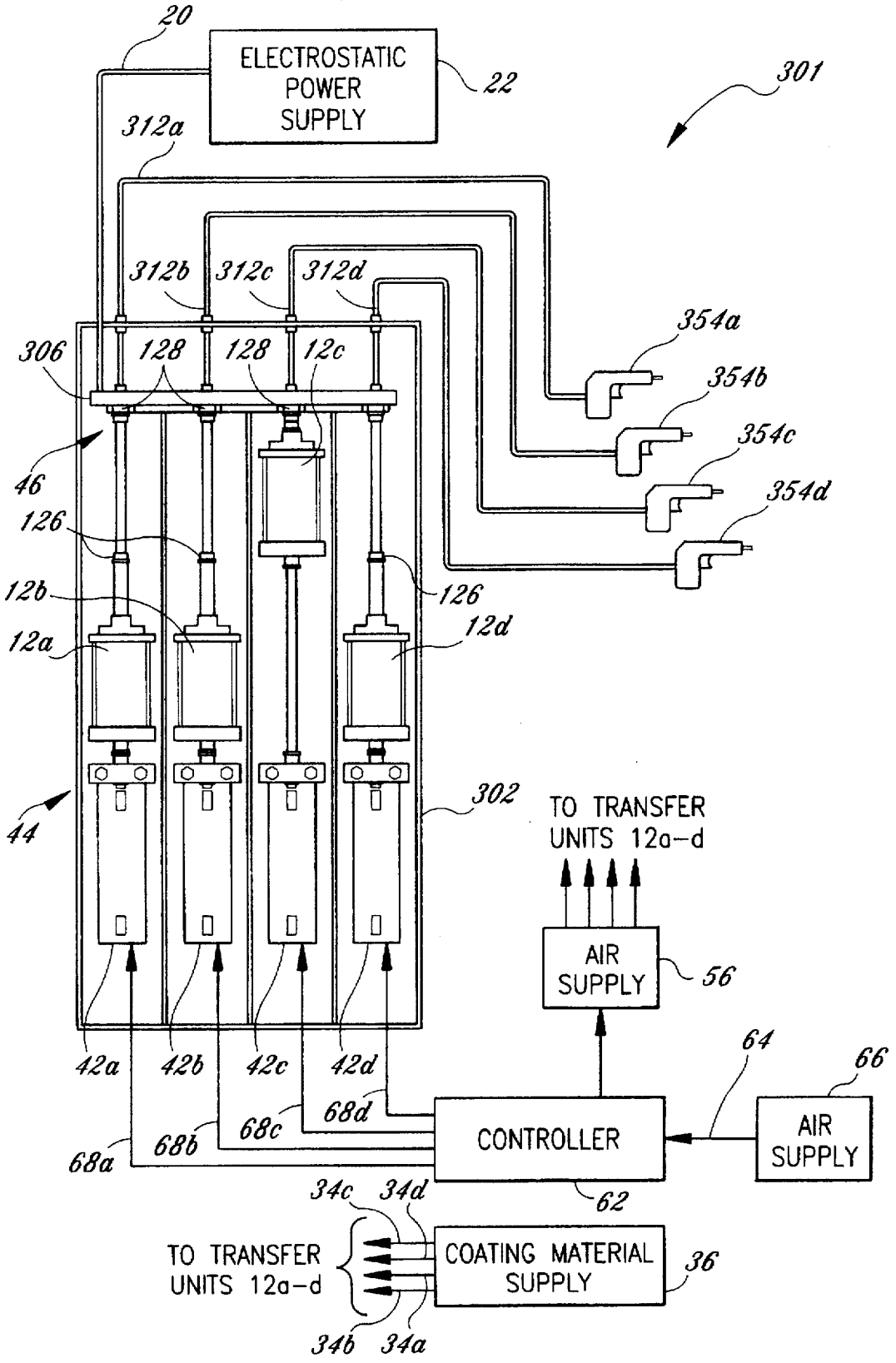
FIG. 9*b* is a view similar to FIG. 9*a*, except with manually operated coating dispensers without a color changer.

With reference to FIG. 9*b*, a manual version of this invention is depicted and identified with the reference number 301. Apparatus 301 is similar in many respects to apparatus 300 of FIG. 9*a*, and like reference number are employed in both Figs. to identify the same structural elements. The principal difference of apparatus 301 is that the color changer 308 is eliminated and lines 312*a–d* are instead directly connected to separate, manually operated spray guns 354*a–d*, respectively. These spray guns 354*a–d* can be of essentially any commercially available type.

As described below, when one of the transfer units 12*a–d* is positioned at its respective filling station 322, the associated spray gun 354*a–d* can be activated to receive coating material via its line 312*a–d* for application onto a particular substrate.

Coating Material Transfer Units

Figure 5:
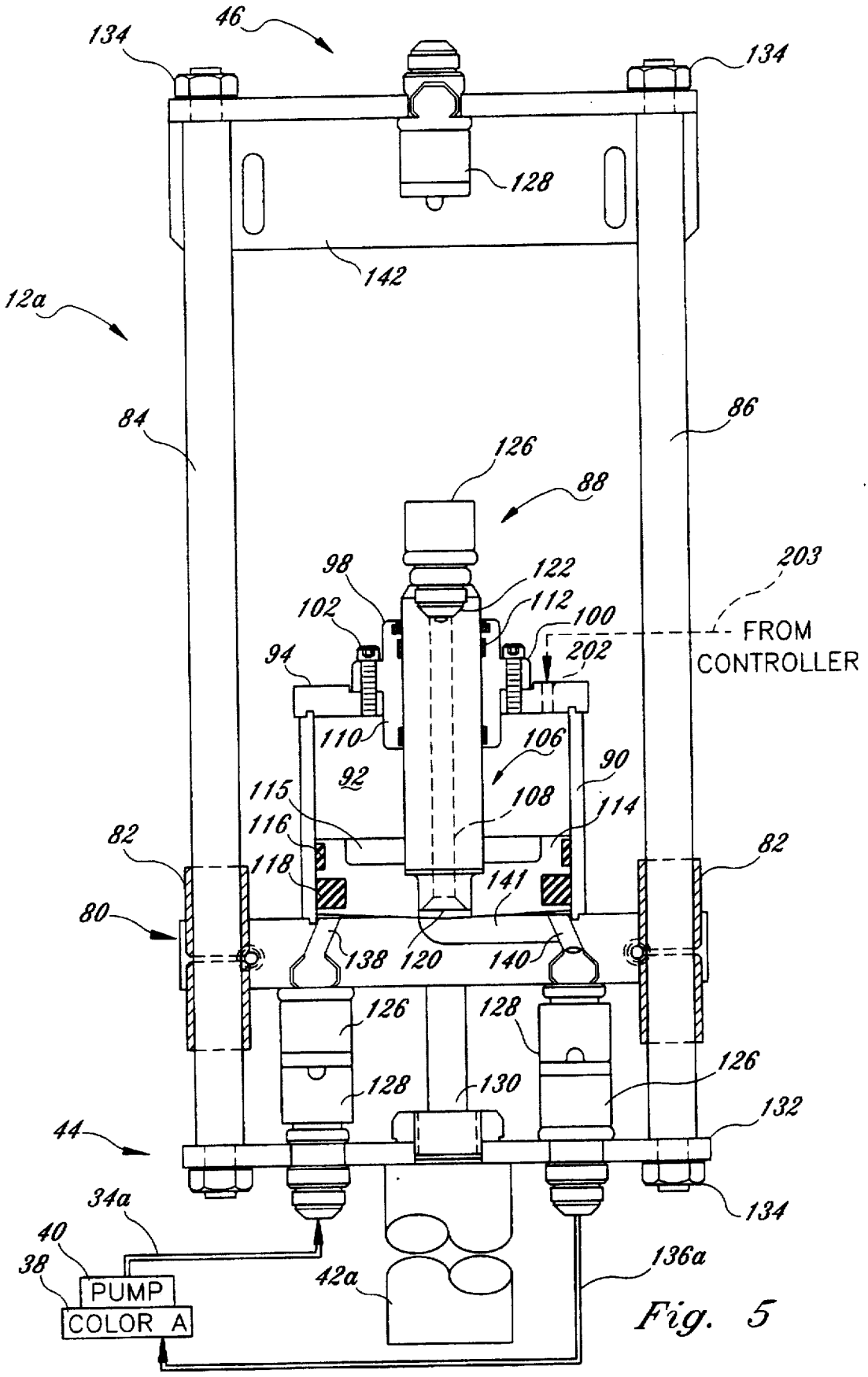
FIG. 5 is an enlarged elevational view, in partial cross section, depicting one embodiment of a coating transfer unit of this invention located at the filling station.
Figure 6:
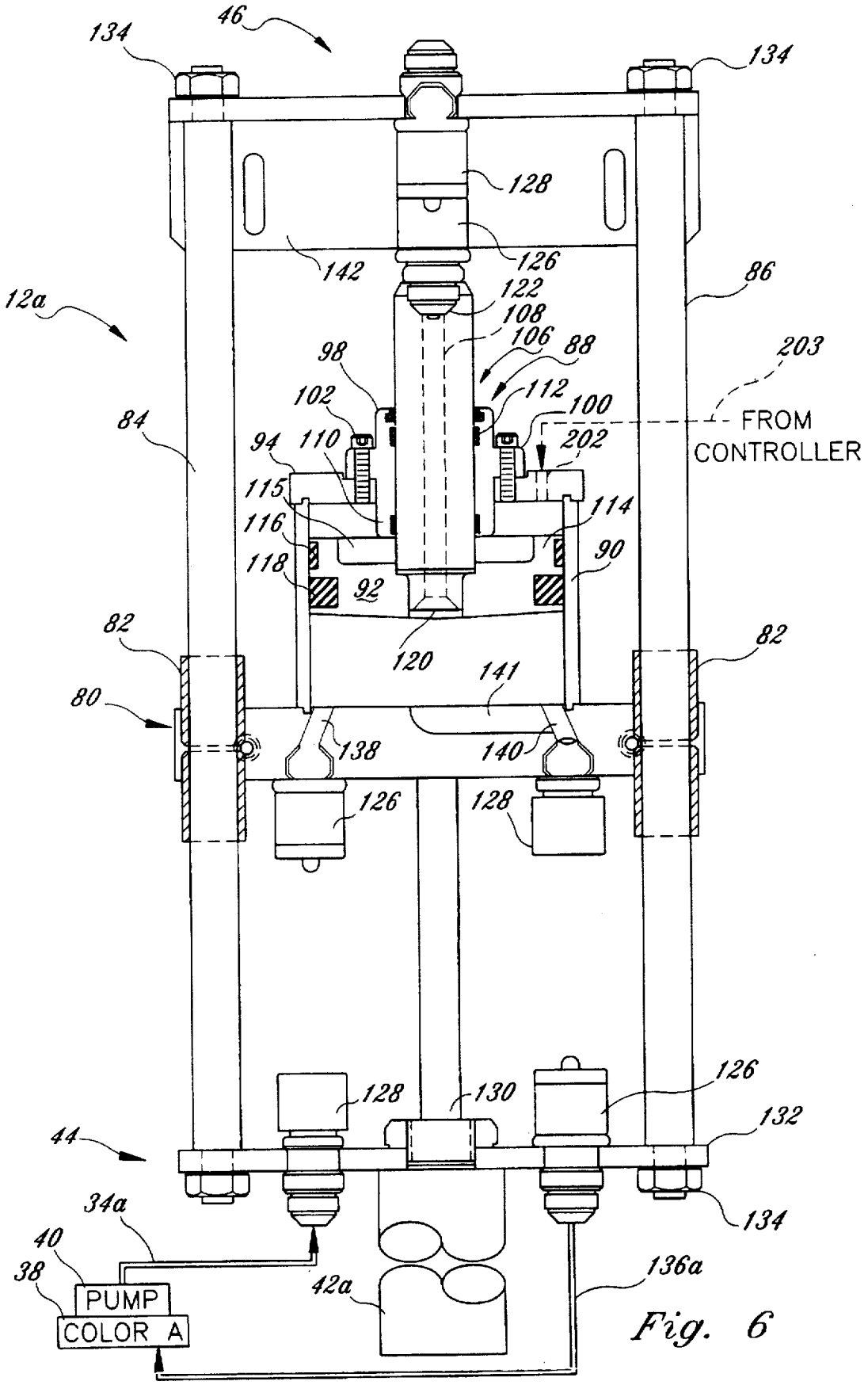
FIG. 6 is a view similar to FIG. 5 except with the coating transfer unit at the discharge station.

With reference initially to FIGS. 5 and 6, the coating material transfer units 12*a–j* are illustrated in detail. It should be understood that each of the transfer units 12*a–j* is identical in structure and operation, and therefore only the transfer unit 12*a* is described herein.

The transfer unit 12*a* comprises a shuttle 80 having opposed ends which are mounted by bushings 82 onto a pair of guide rods 84, 86 extending between the filling station 44 and discharge station 46. The shuttle 80 carries a pumping device 88 which includes a pump body having a generally cylindrical-shaped wall 90 defining a hollow interior 92 closed at one end by a cap 94. The opposite end of wall 90 is mounted atop the shuttle 80. The cap 94 is formed with a central throughbore which mounts a sleeve 98 having flanges 100 which receive mounting screws 102 insertable into the cap 94. The sleeve 98, in turn, is formed with a throughbore which slidably receives a pump piston 106 having a central passageway 108. Preferably, a pair of O-ring seals 110, 112 are carried by the sleeve 98 along the throughbore therein to create a seal with the pump piston 106.

One end of the pump piston 106 mounts a piston head 114 having an outer circumference which carries an O-ring seal 116. A second, annular seal 118 is carried in a seat formed at the base of piston head 114 which, in addition to seal 116, provides a fluid tight connection between the piston head 114 and the wall 90 of pumping device 88 as the piston head 114 moves within the pump interior 92 in the manner described below. The central passageway 108 of pump piston 106 has an inlet 120 at the piston head 114, and an outlet 122 which mounts a female coupling element 126. The female coupling element 126 mates with a male coupling element 128 located at the discharge station 46, as described in more detail below. Coupling elements 126, 128 are preferably of the type disclosed in U.S. Pat. No. 5,078,168, owned by the assignee of this invention, the disclosure of which is incorporated by reference in its entirety herein.

As noted above, each of the transfer units 12*a–j* is associated with a separate fluid cylinder 42*a–j*. As shown in FIG. 5, the fluid cylinder 42*a* is connected by piston rod 130 to the shuttle 80 such that extension and retraction of the piston rod 130 moves the shuttle 80, and, hence, the pumping device 88, between the filling station 44 (FIG. 5) and the discharge station 46 (FIG. 6). The fluid cylinder 42*a* is carried by a plate 132 to which the guide rods 84, 86 are mounted by bolts 134. The plate 132 also carries a male coupling element 128 connected by line 34*a* to pump 40 associated with container 38 having a particular colored coating material therein, e.g. "Color A" as noted in FIGS. 5 and 6. A female coupling element 126 is also mounted to plate 132, which is connected by a return line 136*a* to the container 38.

With the shuttle 80 and pumping device 88 of transfer unit 12 located at the filling station 44, the male coupling element 128 carried by plate 132 mates with a female coupling element 126 mounted at the base of shuttle 80, and the female coupling element 126 carried by plate 132 mates with a male coupling element 128 mounted to the base of shuttle 80. As shown in FIG. 5, the female coupling element 126 carried by the shuttle 80 is located at the entrance of an inlet passageway 138 formed in the shuttle 80 which has an outlet within the interior 92 of pumping device 88. Similarly, the male coupling element 128 mounted at the base of shuttle 80 is connected to the outlet of an outlet or return passageway 140 formed in shuttle 80 whose opposite end opens into the interior 92 of pumping device 88. Preferably, a drain channel 141 is formed along the upper portion of shuttle 80, within the pump interior 92, which is connected to the return passageway 140.

As described more filly below, coating material from the container 38 is directed by pump 40 via line 34*a* through the coupling elements 126, 128, into the inlet passage 138 of shuttle 80, and from there to the interior 92 of pumping device 88. This causes the pump piston 106 and piston head 114 to move upwardly as a unit relative to the pump interior 92, i.e. in a vertically upward direction as drawn in FIG. 5. Movement of the piston head 114 ceases when it engages the cap 94 of pumping device 88, and a recess 115 is formed along the upper surface of piston head 114 to avoid interference with sleeve 98. Continued operation of pump 40 after the interior 92 of pumping device 88 has been filled causes the coating material to recirculate from the pump interior 92, through return passageway 140 and return line 136*a*, back to the container 38.

Once filled with coating material, the shuttle 80 and pumping device 88 can be moved, if desired, into position at the discharge station 46 located at manifold 16. This is achieved by operating fluid cylinder 42 to extend its piston rod 130, thus separating the coupling elements 126, 128 at the filling station 44 and causing the female coupling element 126 carried by the pump piston 106 to engage and mate with the male coupling element 128 at the discharge station 46. In the presently preferred embodiment, a bracket 142 is located at the discharge station 46 which mounts the opposite end of guide rods 84, 86 with bolts 134. The bracket 142 also mounts the male coupling element 128, which, in turn, is connected to the interior 18 of manifold 16.

Figure 7:
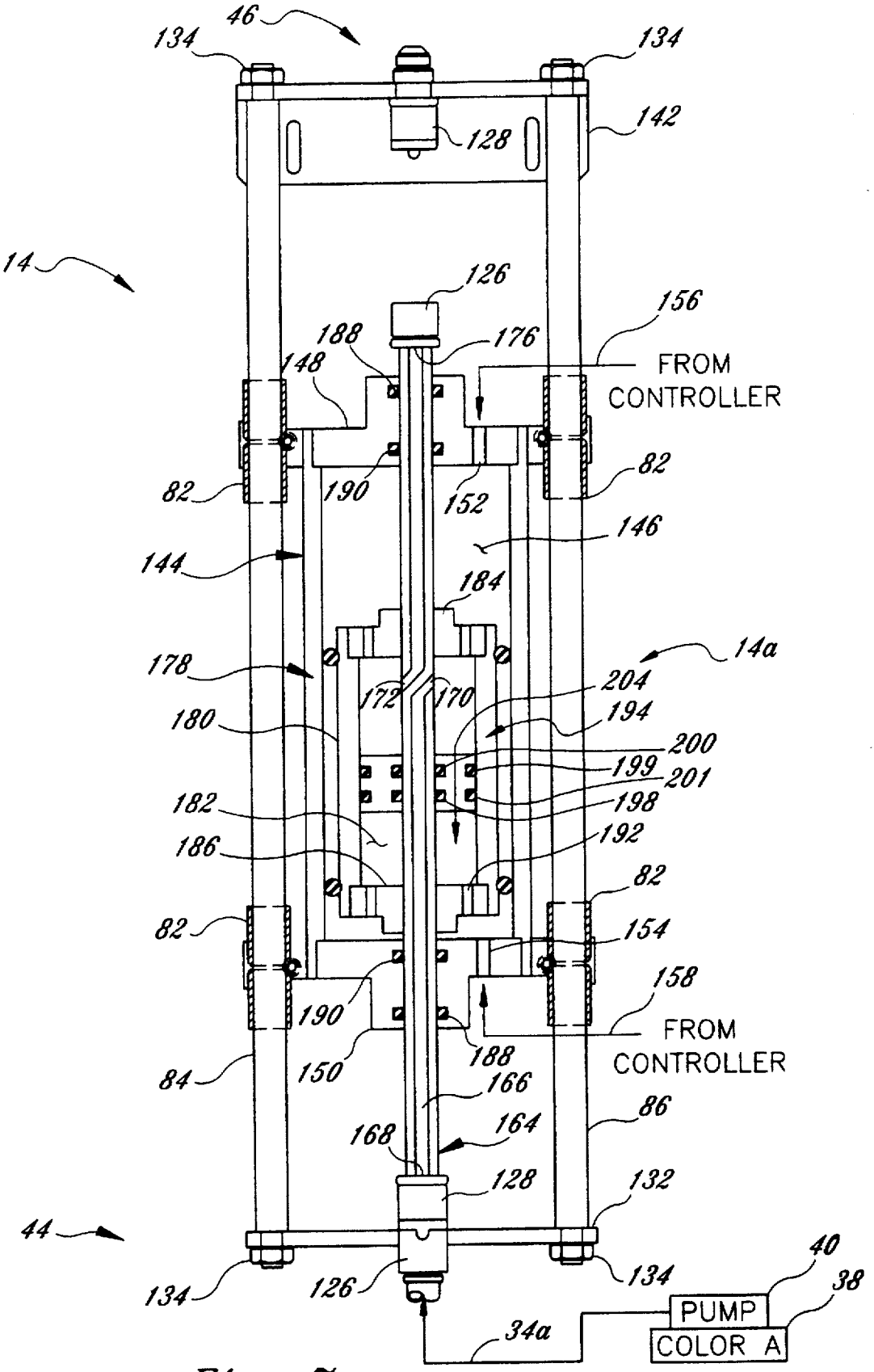
FIG. 7 is an elevational view, in partial cross section, of an alternative embodiment of a coating transfer unit of this invention located at the filling station.
Figure 8:
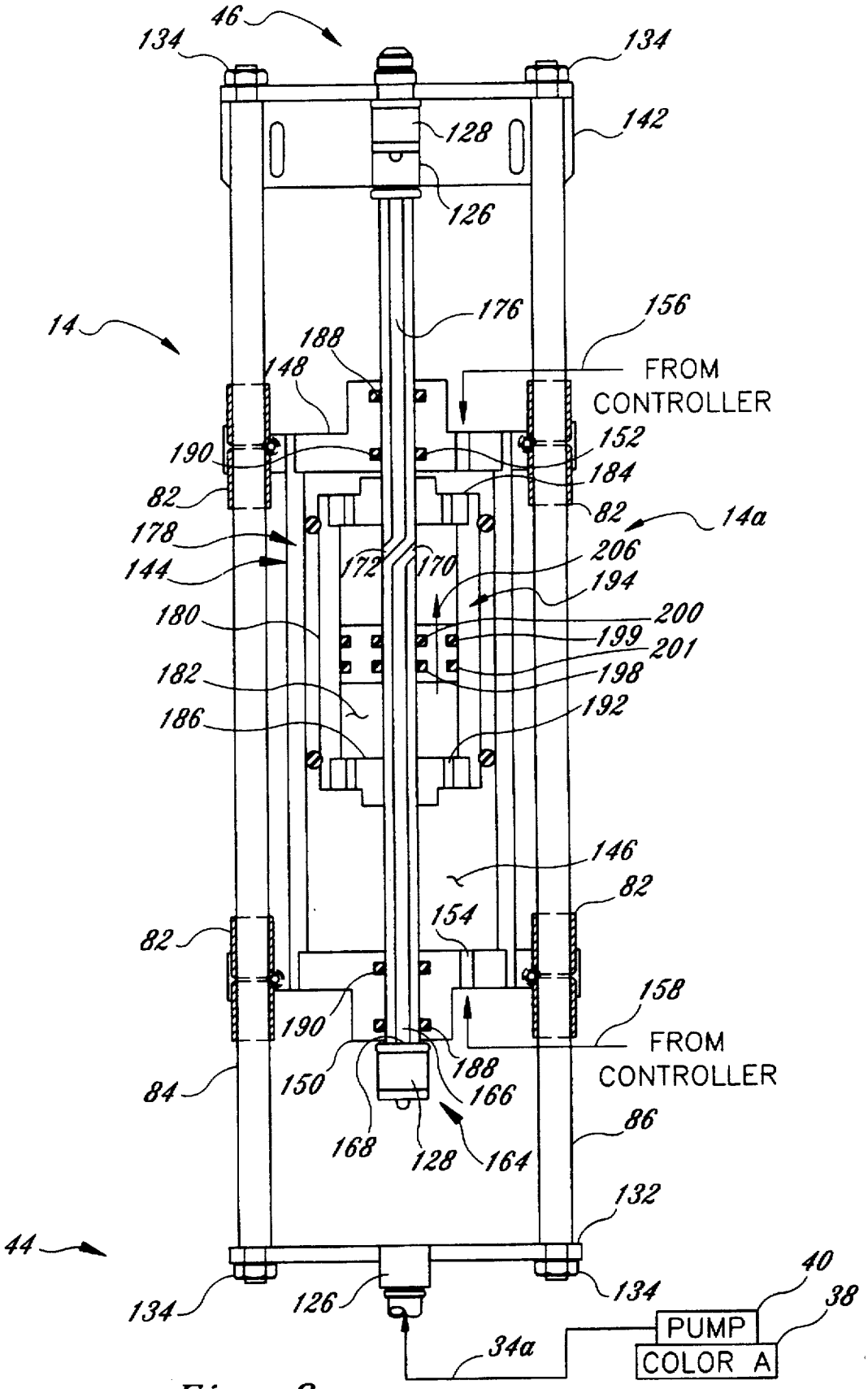
FIG. 8 is a view similar to FIG. 7 except with the coating transfer unit at a discharge station.

With reference now to FIGS. 7 and 8, the alternative transfer unit 14 is illustrated in detail. Transfer units 14*a–j* are employed in the apparatus 10 in the same manner as described above, except for a slight modification at the filling station 44, and the elimination of fluid cylinders 42*a–j*.

In the presently preferred embodiment, transfer unit 14*a* comprises a shuttle 144 having a hollow interior 146 which is closed at opposite ends by a first end cap 148 and a second end cap 150. The shuttle 144 is movable along guide rods 84, 86 as with the shuttle 80 described above. The end caps 148, 150 are formed with air ports 152 and 154, respectively, connected to air lines 156 and 158 from controller 62.

Additionally, the end caps 148, 150 each have a central throughbore within which a shaft 164 is fixedly mounted. The shaft 164 is formed with a first passageway 166, having an inlet 168 at one end of shaft 164 and an outlet 170 approximately midway therealong. The shaft 164 is also formed with a second passageway 172 having an inlet 174 adjacent the outlet 170 of first passageway 166, and an outlet 176 at the opposite end of shaft 164. A male coupling element 128 is mounted to shaft 164 at the inlet 168 to first passageway 166, and a female coupling element 126 is mounted at the outlet 176 of the second passageway 172 of shaft 164.

The shuttle 144 carries a pumping device 178 within the hollow interior 146 thereof which is slidable along the fixed shaft 164. The pumping device 178 comprises a pump body 180 having a cylindrical wall defining a hollow interior 182 which is closed at opposite ends by closure plates 184, 186 each having a central bore to slidably receive the shaft 164. Preferably, O-ring seals 188, 190 are carried by each of the closure plates 184, 186 within their throughbores to create a fluid tight seal with shaft 164. Additionally, the closure plate 186 is formed with an air port 192 which extends into the pump interior 182.

A pump piston 194 is slidably mounted on the shaft 164 within the interior 182 of pumping device 178. The circumference of pump piston 94 carries seals 198, 199 to create a fluid tight seal with a cylindrical wall 180 of pumping device 178, and seals 200, 201 are mounted at the interface between the throughbore of pump piston 194 and shaft 164 to create a seal therebetween. The operation of transfer unit 14 is described in detail below in connection with a discussion of the overall operation of apparatus 10.

Coating Operation

With reference initially to FIGS. 1, 5 and 6, the following operations are described: (1) filling each of the transfer units 12*a–j* with coating material, and (2) selectively moving one of the transfer units 12*a–j* to the discharge station 46 to transfer coating material into the manifold 16 for supply to the coating dispensers 30.

The controller 62 is operative to supply pressurized air through lines 34*a–j* to each of the fluid cylinders 42*a–j* so that their piston rods 130 are retracted to move the transfer units 12*a–j* to the filling station 44. As mentioned above, at the filling station 44, the coupling elements 126, 128 carried by shuttle 80 mate with coupling elements 126, 128 mounted to the plate 132. See FIG. 5. Once the shuttle 80 and pumping device 88 of the transfer units 12*a–j* are in position at the filling station 44, each of the pumps 40 within the coating material supply 36 is activated to direct coating material from the individual coating material containers 38 into their associated transfer units 12*a–j*. The coating material flows from containers 38 into supply lines 34*a–j*, each of which leads to a male coupling element 128 carried by the plate 132 at the filling station 44. The coating material passes through the male coupling elements into the mating female coupling elements 126 mounted to shuttle 80, through the inlet passage 138 of shuttle 80 and then into the interior 92 of each pumping device 88. As each pumping device 88 fills with coating material, its piston head 114 moves vertically upwardly as depicted in FIG. 5 carrying with it the pump piston 106. Filling of each pumping device 88 continues until the piston head 114 engages the cap 94. When the pumping device 88 is completely filled, and with the shuttle 80 and pumping device 88 located at the filling station 44, additional coating material entering the pump interior 92 is recirculated back to the container 38 via a flow path formed by the drain channel 141 and return passage 140 in shuttle 80, the mating coupling elements 126, 128 which connect to return passage 140, and, the return line 136 extending between the male coupling element 128 at the discharge station 46 and the container 38. This recirculation feature of transfer unit 12 is advantageous when spraying electrically conductive coating material such as water-based paint because continuous movement of the coating material substantially prevents settlement of sediments and other solid materials contained within the coating material.

In order to initiate a coating operation with a chosen color of coating material, the controller 62 pressurizes the appropriate fluid cylinder 42*a–j* via its associated air line 68*a–j* so that the piston rod 130 of such fluid cylinder 42*a–j* is extended. For purposes of illustration, FIG. 1 shows actuation of fluid cylinder 42*i* which moves transfer unit 12*i* to the discharge station 46 at manifold 16. See also FIG. 6. In the course of movement to the discharge station 46, the coupling elements 126, 128 carried by the shuttle 80 disconnect the mating coupling elements 126, 128 mounted to the plate 132 at the filling station 44. Upon reaching the discharge station 46, the female coupling element 126 carried at the outwardly extending end of pump piston 106 mates with the male coupling element 128 carried by the bracket 142 at the discharge station 46. Because the bracket 142 and male coupling element 128 are mounted in a fixed position at the discharge station 46, the vertically upwardly directed force exerted by the piston rod 130 of fluid cylinder 42*i* forces the pump piston 106 and piston head 114 in the opposite, downward direction within the interior 92 of pumping device 88. In turn, the coating material within the pumping interior 92 is forced, under pressure, through the central passageway 108 of pump piston 106 into the mating coupling elements 126, 128 at the discharge station 46. The coating material enters the manifold interior 18 via the male coupling element 128, and is transferred along manifold 16 through the paint supply tube 28 to one or more coating dispensers 30.

The magnitude of the pressure at which the coating material is supplied to the coating dispensers 30 is therefore dependent upon the force exerted by the piston 130 of fluid cylinder 42*i* on the shuttle 80. The fluid cylinder 42*i* urges the shuttle 80 and pumping device 88 in an upward direction thus forcing the pump piston 106, which has engaged the fixed male coupling element 128, in the opposite, downward direction. In turn, the piston head 114 bears against the coating material within the pumping device interior 92 causing it to enter into the passageway 108 of pump piston 106. The pressure at which the coating material is supplied to the dispensers 30 can be varied by employing fluid cylinders 42 of different size, as desired. Additionally, it is contemplated that an air port 202, shown in phantom in FIGS. 5 and 6, can be formed in the pump cap 94 above the piston head 114 so that pressurized air can be introduced atop the piston head 114 via line 203 from controller 62 to augment the force exerted by the pump piston 106 and piston head 114 on the coating material within the pump interior 92.

Once the piston head 114 has bottomed out within the pump interior 92, or when the coating operation is otherwise discontinued, the controller 62 operates the fluid cylinder 42*i* to retract its piston rod 130 causing the pumping device 88 to disconnect from discharge station 46. The shuttle 80 and pumping device 88 then move as a unit to the filling station 44 where the filling operation takes place again as described above.

With reference to FIGS. 1, 7 and 8, a filling and discharge operation are described for a transfer unit 14*a*, it being understood that all transfer units 14*a–j* are structurally and functionally identical. Initially, the controllei 62 is operated to direct pressurized air through line 156 into the air port 152 of shuttle 144. This forces the pumping device 178 in a downward direction as viewed in FIGS. 7 and 8 into engagement with the second end cap 150 of shuttle 144. In turn, both the shuttle 144 and pumping device 178 move downwardly along guide rods 84, 86 to the filling station 44. At the filling station 44, the male coupling element 128 carried at one end of the shaft 164 mates with a female coupling element 126 mounted to the plate 132 depicted schematically in FIG. 7. The female coupling element is connected by line 34*a* to a pump 40 and container 38 located internally of the coating material supply 36. The pump 40 is activated to direct the coating material through line 34*a* to the mating coupling elements 126, 128, and then into the inlet 168 of the first passageway 166 within shaft 164. The coating material is discharged through the outlet 170 of first passageway 166, and into the interior 182 of pumping device 178 on the side of pump piston 194 opposite the air port 192 and closure plate 186. As the pump interior 182 fills with coating material, the pump piston 194 moves in the direction of arrow 204 within the pump interior 182, i.e. along shaft 164 toward the closure plate 186. Filling of the pumping device 178 ceases when pump piston 194 engages closure plate 186.

In order to initiate a coating operation with transfer unit 14*a*, the controller 62 directs pressurized air into line 158 and through the air port 154 in the second end cap 150 of shuttle 144. At the same time, pressurized air within the shuttle interior 146 is vented through air port 152 and line 156. Pressurization of the shuttle 144 through line 158 and air port 154 causes the entire pumping device 178 to move toward and engage the first end cap 148. In turn, both the shuttle 144 and pumping device 178 move along guide rods 84, 86 to the discharge station 46 at the manifold 16 where the female coupling element 126 carried by shaft 164 mates with the male coupling element 128 mounted to bracket 142.

Because the air port 192 within closure plate 186 of pumping device 178 is located on the same end of shuttle 144 as air port 154, the interior of pumping device 178 becomes pressurized with the air from line 158. Consequently, the pump piston 194 of pumping device 178 is forced in a direction toward the closure plate 184 of pumping device 178, as shown by arrow 206 in FIG. 8. Coating material within the pump interior 182 is forced into the second passageway 172 within shaft 164 from which it flows through the interconnected coupling elements 126, 128 at the discharge station 46 into the manifold 16. The coating material continues through manifold 16 into paint supply tube 28 to the coating dispensers 30. The magnitude of the pressure at which the coating material is supplied to the dispensers 30 is therefore dependent upon the air pressure applied to the pump piston 194 via line 158 and controller 62.

When the coating operation has been completed, or is otherwise discontinued, the shuttle 144 and pumping device 178 are returned to the filling station 44 by directing pressurized air from controller 62 into line 156 and venting air from the opposite end of shuttle 144 through line 158. The pump filling procedure is then repeated as discussed above in preparation for another coating operation.

The operation of apparatus 300 is similar to that described above in connection with a discussion of apparatus 10, except the manifold 16 is eliminated and a color changer 308 is employed. With reference to FIG. 9*a*, each of the transfer units 12*a–d* is selectively movable to the discharge station 46 at the support bar 306 in the manner described above, so that the coupling element 126 of each shuttle 80 mates with a coupling element 128 carried by the support bar 306. The pumping device 88 then operates to discharge coating material, as described above, to provide a flow of coating material through one of the lines 312*a–d* to the color changer 308. The color changer 308, in turn, directs coating material of a selected color through line 312 to dispenser 30 which is automatically operated by the controller 62 via a signal sent through line 78.

With respect to the apparatus 301 depicted in FIG. 9*b*, the transfer units 12*a–d* are movable in the same manner described above in connection with the discussion of FIG. 9*a*. In this manually operated embodiment, however, each spray gun 354*a–d* is separately and manually operated by human intervention. In the position of apparatus 301 in FIG. 9*b*, the transfer unit of 12*c* is illustrated at its associated filling station 322*c* so that coating material can be delivered through line 12*c* to the spray gun 354*c*. In this position, the spray gun 354*c* can be manually actuated to deliver coating material onto a substrate of interest while a voltage block is maintained between transfer units 12*a*, 12*b* and 12*d*, and their respective spray guns 354*a*, 354*b* and 354*d*. It is contemplated that more than one transfer unit 12*a–d* could be moved into a coupling engagement with their respective filling stations 322*a–d* so that multiple spray guns 354*a–d* could be manually operated, as desired for a particular application.

Cleaning Operation

With reference now to FIGS. 1–4, the manifold 16, paint supply tube 28 and dispensers 30 can be easily and quickly cleaned of coating material of one color in preparation for a spraying with coating material of another color. Regardless of whether transfer unit 12 or transfer unit 14 is utilized, the cleaning operation proceeds as follows.

Initially, the controller 62 directs pressurized air to the fluid cylinder 60 associated with water transfer unit 50. The fluid cylinder 60 moves water transfer unit 50 into position at the water valve 24. See FIG. 2. Preferably, the water valve 24 and water transfer unit 50 have mating coupling elements 126, 128 of the type described above. Additionally, in the presently preferred embodiment, the structure and operation of water transfer unit 50 is identical to the transfer units 12 previously discussed.

The arrival of the water transfer unit 50 at water valve 24 is timed to take place near the end of a painting cycle, e.g. such as when the interior 92*i* of transfer unit 12*i* is nearly emptied of paint or the painting operation is otherwise ready to be terminated. The controller 62 then depressurizes the fluid cylinder 42*i* associated with transfer unit 12*i* to stop the flow of paint therefrom, and opens water valve 24 to permit a flow of water or other cleaning fluid from the pumping device 88 of water transfer unit 50 into the interior of manifold 16. The flow of water within manifold 16 "pushes" the paint remaining therein, and within the supply tube 28, through the dispenser 30 and onto the object to be coated. Consequently, the system 10 is still painting, even with the transfer unit 12*i* disengaged, in response to the "push" provided by the water from water transfer unit 50. Because the water transfer unit 50 is electrically isolated in the same manner as transfer units 12, the system electrostatics are not grounded while the paint remaining within manifold 18 and supply tube 28 is transferred to dispenser 30. The flow of water from water transfer unit 50 is timed by the controller 62 to stop before the water is discharged from dispenser 30. At that time, both the transfer unit 12*i* which was supplying coating material, and the water transfer unit 50, are returned to their respective filling stations 44 and the electrostatic power supply 22 is turned off. The controller 62 then operates the fluid cylinder 58 to move water shuttle 48 into a coupled position at the water valve 24. The controller 62 opens the water valve 24, and opens the air purge valve 26, to direct a combination of air and water through the interior 18 of manifold 16, into paint supply tube 28 and into coating dispenser 30. The combined air/water mixture is effective to remove coating material from the interior 18 of manifold 16 and from the paint supply tube 28 leading to dispenser 30. After the manifold 16 and paint supply tube 28 have been thoroughly flushed and cleaned, the controller 62 operates fluid cylinder 58 to return the water shuttle 48 to a neutral position spaced from the manifold 16.

Figure 4:
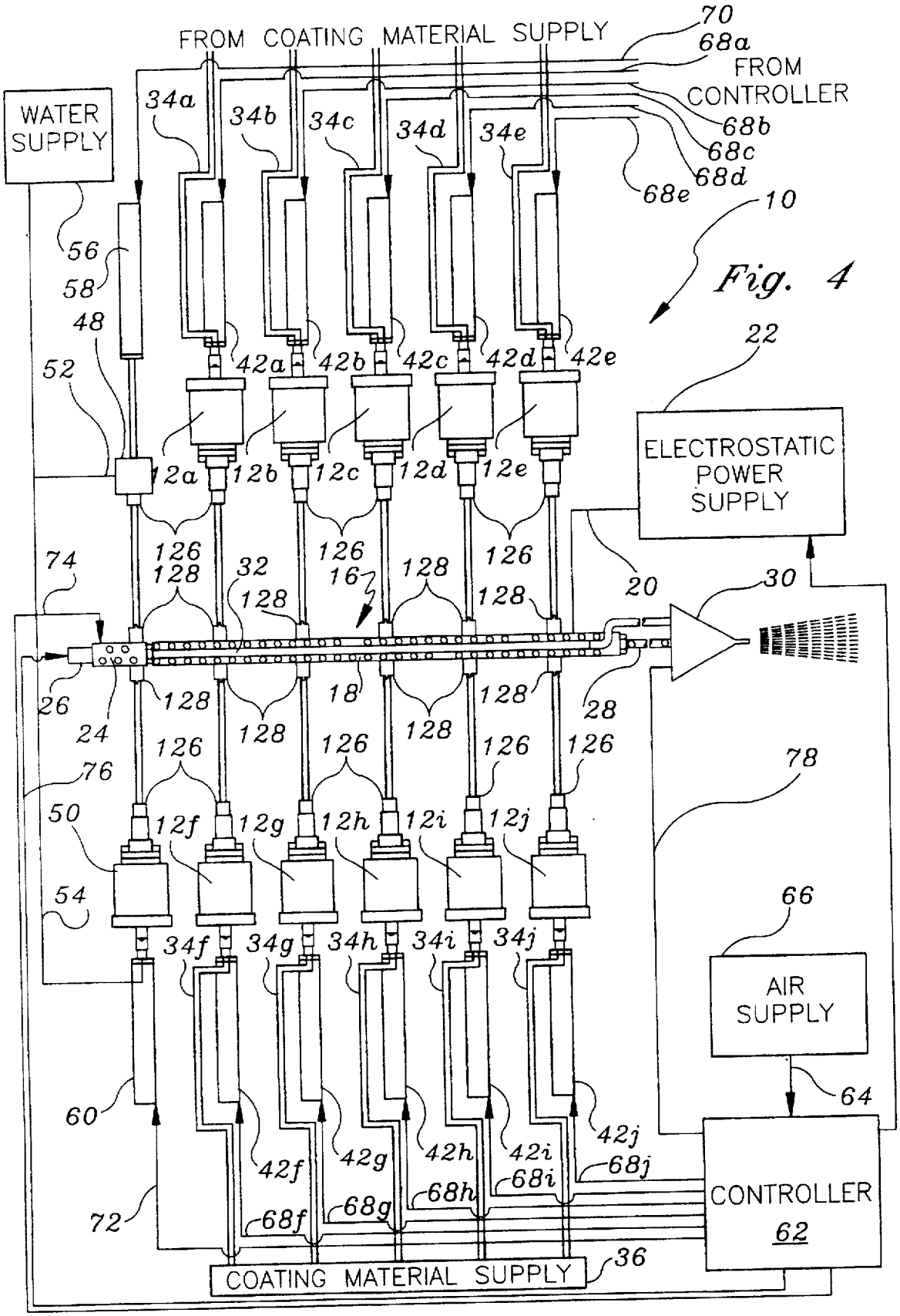
FIG. 4 is a view similar to FIG. 1 wherein pressurized air is directed through the system.

In the presently preferred embodiment, as shown in FIG. 4, the air purge valve 26 is then reopened by the controller 62 to direct pressurized air through the manifold 16, paint supply tube 28 and coating dispensers 30 to purge the cleaning water from the system. After the air purge is completed, the controller 62 closes the air purge valve 26 and operates one of the fluid cylinders 42*a–j* to move a selected transfer unit 12*a–j* to its discharge station 46 at manifold 16. The coating operation with a different colored coating material from such other transfer unit 12*a–j* is then initiated in the same manner as described above.

It is contemplated that in addition to the above-described cleaning operation, the nozzle or cup (not shown) of the coating dispenser 30 should be cleaned in those situations where it is desired to continue painting with the same color of coating material after an initial coating operation is completed, or in the event a coating operation is interrupted. Without a separate cleaning operation for dispenser 30, it is contemplated that coating material could at least partially dry or clump up within the dispenser interior and/or the nozzle or cup thereof before the painting operation was resumed, thus producing an unacceptable spray pattern when the coating operation is resumed.

A cleaning operation for the dispenser 30, and particularly the nozzle or cup portion thereof, proceeds as follows. Initially, the flow of paint from one of transfer units 12*a–j* is terminated, and the electrostatic power supply 22 is turned off to de-energize the manifold 18 and dispenser 30. The shuttle 80 associated with the transfer unit 12*a–j* which was painting, e.g. shuffle 80 of transfer unit 12*i*, is returned to its filling station 44 to receive additional coating material. The controller 62 then moves either the water shuttle 48 or water transfer unit 50 into coupling engagement with water valve 24, and opens the water valve 24 so that it communicates with water flush tube 32. Preferably, the water valve 24 is a two position valve which is adjustable to permit the flow of water or other flushing liquid either into the interior 18 of manifold 16 or into the water flush tube 32 within the manifold interior 18. With the water flush valve 24 in proper position, a flow of water from either water shuttle 48 or water transfer unit 50 flows therethrough, into the water flush tube 32 and then into the dispenser 30. The dispenser 30 is triggered, either manually or automatically by controller 62, to flush any residue paint therefrom and particularly from the area of the nozzle or cup portion of the dispenser 30. The water shuttle 48 or water transfer unit 50 is then disengaged from the water valve 24 and returned to the initial position, while the dispenser 30 is triggered again to remove any remaining water therein. The apparatus 10 is now ready for the painting operation to resume, either by returning the now re-filled transfer unit 12*i* to the manifold 16 or moving another transfer unit 12 carrying the same color to the manifold 16.

The cleaning operation for apparatus 300 proceeds differently since only the color changer 308, outlet line 316 and dispenser 30 must be flushed to convert from one color of coating material to another. The controller 62 operates a valve (not shown) associated with the inlet 320 of color changer 308 to permit the flow of water into the color changer 308 via water line 352, and then through outlet line 316 to dispenser 30. The voltage block 320 is interposed between the water supply 56 and color changer 308 to prevent grounding of the electrostatically charged coating material supplied from transfer units 12*a–d* during a coating operation. During a cleaning operation, the cylinder 334 is actuated to move shuttle 332 to the transfer position wherein coupling elements 324 and 340 are engaged and a flow path is provided for the water or flushing fluid from supply 56, through lines 350, 352 to the inlet 320 of color changer 308.

Simultaneous with and/or subsequent to the water flush sequence, the controller 62 operates a valve associated with the color changer 308, which is connected via air line 324 and controller 62 to air supply 66, to allow the introduction of pressurized air into color changer 308. The combined water and air flush of color changer 308, coating line 316 and dispenser 30 after one coating operation with one color is effective to rapidly prepare the apparatus 300 for another coating operation with a different color.

With respect to cleaning of the apparatus 301 of FIG. 9*b*, a cleaning fluid such as water is provided from a source 56 into each of the transfer units 12*a–d* which, in turn, deliver the cleaning fluid through their associated filling stations 322*a–d*, lines 312*a–d*, and spray guns 354*a–d* to complete the cleaning operation. The transfer of cleaning fluid or water from supply 56 is controlled by a signal from the controller 62 via line 356.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the invention has been described and shown as either including a manifold 16, a color changer 308 or individual spray guns 354*a–d* so that a number of different sources of coating material can be employed, each associated with a separate coating transfer unit 12 or 14. It is also contemplated that the apparatus 10 of this invention could be fabricated with a single source, one set of filling and discharge stations and a single coating transfer unit 12 or 14, wherein the manifold and color changer are eliminated.

Therefore, it is intended that the invention not be limited to the particular embodiment disclosed as the best mode contemplated for carrying out this invention, but that the invention will include all embodiments falling within the scope of the appended claims.

We claim:

1. Apparatus for supplying an electrically conductive coating material, comprising:

a manually operated coating dispenser;

a discharge station connected to said manually operated coating dispenser;

a filling station connected to a source of coating material, said filling station being electrically isolated from said discharge station;

a shuttle device and a pumping device which are combined to form an integral coating transfer unit, said coating transfer unit being movable to said filling station at which a quantity of coating material is transferred from said source of coating material into said pumping device of said coating transfer unit, and said coating transfer unit thereafter being movable to said discharge station at which the coating material is transferred from said pumping device of said coating transfer unit, through said discharge station and to said manually operated coating dispenser.

2. Apparatus for supplying electrically conductive coating material, comprising:

an automatically operated coating dispenser;

a number of discharge stations;

a color changer connected between said discharge stations and said automatically operated coating dispenser;

a number of filling stations each connected to a different source of coating material, said filling stations being electrically isolated from said discharge stations;

a number of coating transfer units each including a shuttle device and a pumping device which are integrally combined, each of said coating transfer units being movable to one of said filling stations at which a quantity of coating material is transferred from a different source of coating material into said pumping device thereof, each of said coating transfer units thereafter being selectively movable to one of said discharge stations at which the coating material from said pumping device thereof is transmitted to said color changer for supply to said automatically operated coating dispenser.

3. The apparatus of claim 2 in which said color changer is formed with a number of inlets and at least one outlet connectable to said automatically operated coating dispenser, each of said inlets being connected by a separate line to one of said discharge stations.

4. The apparatus of claim 2 further including a voltage block device interposed between a source of cleaning fluid and said color changer, said voltage block device being effective to electrically isolate said source of cleaning fluid from said color changer during operation of said coating dispenser, and to supply cleaning fluid to said color changer to remove coating material therefrom.

5. The apparatus of claim 2 further including a dump tank and a voltage block device interposed between said dump tank and said automatically operated coating dispenser, said voltage block device being effective to electrically isolate said dump tank from said coating dispenser during operation thereof, and to permit the transfer of coating material or cleaning fluid from said coating dispenser into said dump tank.

* * * * *